US009657452B2

(12) United States Patent
Bailey

(10) Patent No.: US 9,657,452 B2
(45) Date of Patent: May 23, 2017

(54) METHOD OF MANUFACTURE OF A BARRAGE UNIT

(75) Inventor: Richard J. Bailey, Huddersfield (GB)

(73) Assignee: ENVIRONMENTAL DEFENCE SYSTEMS LIMITED, Huddersfield, West Yorkshire (GB)

( * ) Notice: Subject to any disclaimer, the term of this patent is extended or adjusted under 35 U.S.C. 154(b) by 869 days.

(21) Appl. No.: 13/510,836

(22) PCT Filed: Nov. 19, 2010

(86) PCT No.: PCT/GB2010/051923

§ 371 (c)(1),
(2), (4) Date: Jun. 15, 2012

(87) PCT Pub. No.: WO2011/061539

PCT Pub. Date: May 26, 2011

(65) Prior Publication Data

US 2012/0257928 A1 Oct. 11, 2012

(30) Foreign Application Priority Data

Nov. 19, 2009 (GB) ..... 0920284.7

(51) Int. Cl.
*B65B 1/04* (2006.01)
*E02B 7/02* (2006.01)
(Continued)

(52) U.S. Cl.
CPC ..... *E02B 3/127* (2013.01); *B01F 3/18* (2013.01); *B01F 5/02* (2013.01); *B65B 11/00* (2013.01);
(Continued)

(58) Field of Classification Search
CPC .. B65B 9/00; B65B 9/02; B65B 11/00; B65B 11/50; B65B 11/52; B65D 65/44;
(Continued)

(56) References Cited

U.S. PATENT DOCUMENTS 985,299 A * 2/1911 Soars ..... B01F 9/06 366/187
1,122,260 A * 12/1914 Daly ..... A01C 1/08 366/188
(Continued)

FOREIGN PATENT DOCUMENTS

AU 640204 B2 8/1993
DE 19910366 A1 9/2000
(Continued)

OTHER PUBLICATIONS

Grounds of Invalidity with Annexes A-H, Environmental Defence Systems Limited (Claimant) and Synergy Health PLC et al. (Defendants), Claim No. CC13P03329.
(Continued)

*Primary Examiner* — Stephen F Gerrity
*Assistant Examiner* — Joshua Kotis
(74) *Attorney, Agent, or Firm* — Howard & Howard Attorneys PLLC

(57) ABSTRACT

A method of manufacture of a barrage unit comprising providing a chamber having an outer wall having at least one aperture therein; providing a liner layer proximate to the aperture; blowing the fibers of a fibrous material into the chamber whilst providing an absorbent crystalline material to the chamber such that the two mix and exit the aperture onto the liner forming a pad; and, providing a further liner layer on the pad.

19 Claims, 7 Drawing Sheets

(51) Int. Cl.

| | |
|---|---|
| ***E02B 3/12*** | (2006.01) |
| ***B65B 11/00*** | (2006.01) |
| ***B01F 3/18*** | (2006.01) |
| ***B01F 5/02*** | (2006.01) |
| ***E02B 3/10*** | (2006.01) |
| ***F42D 5/045*** | (2006.01) |
| *E02D 29/02* | (2006.01) |

(52) U.S. Cl.
CPC ..... *E02B 3/108* (2013.01); *F42D 5/045* (2013.01); *E02D 29/0291* (2013.01)

(58) Field of Classification Search
CPC ... E02B 3/04; E02B 3/10; E02B 3/106; E02B 3/108; B01F 3/00; B01F 3/18; B01F 5/0231; B01F 7/005; B01F 7/00508; B01F 7/00516; B01F 7/00525; B01F 7/00541; B01F 7/0055; B01F 7/00583; B01F 7/00216; B01F 7/00225; B01F 9/0001; B01F 9/0005; B01F 9/0007–9/0012; B01F 9/0032–9/0054; B01F 9/02–9/22; A61F 13/15658; A61F 13/534; A61F 13/8405; A61F 2013/15821; A61F 2013/15943; A61F 2013/530496; A61F 2013/530532; A61F 13/151565
USPC ..... 53/428, 450, 461, 435, 474; 425/80.1–83.1; 264/113; 405/77, 78, 405/107–127; 141/9; 156/62.2–62.8, 156/278–279; 222/145.5, 145.6, 553; 366/187, 188
See application file for complete search history.

(56) References Cited

U.S. PATENT DOCUMENTS

| | | | | | |
|---|---|---|---|---|---|
| 1,122,660 | A * | 12/1914 | Sturtevant | A01C 1/08 | 292/49 |
| 1,204,357 | A * | 11/1916 | Jefferson | D06F 39/04 | 162/243 |
| 1,255,196 | A * | 2/1918 | Malm | A01C 1/08 | 366/188 |
| 2,698,271 | A * | 12/1954 | Clark | 264/113 | |
| 2,953,187 | A * | 9/1960 | Francis, Jr. | 425/83.1 | |
| 3,016,582 | A * | 1/1962 | Joa | 425/81.1 | |
| 3,612,054 | A * | 10/1971 | Matsuda et al. | 604/370 | |
| 4,650,368 | A * | 3/1987 | Bayer | 405/111 | |
| 4,919,340 | A * | 4/1990 | Gerber | D21B 1/066 | 241/19 |
| 4,927,582 | A * | 5/1990 | Bryson | 264/113 | |
| 5,028,224 | A * | 7/1991 | Pieper et al. | 425/80.1 | |
| 5,030,314 | A * | 7/1991 | Lang | 156/390 | |
| 5,041,330 | A * | 8/1991 | Heerten et al. | 428/213 | |
| 6,533,978 | B1 * | 3/2003 | Wisneski et al. | 264/113 | |
| 6,662,528 | B2 * | 12/2003 | Holt et al. | 53/417 | |
| 7,449,105 | B2 * | 11/2008 | Hastings | 210/85 | |
| 7,841,268 | B2 * | 11/2010 | Bailey | 89/36.02 | |
| 2007/0156107 | A1 * | 7/2007 | Kimura et al. | 604/368 | |
| 2008/0138157 | A1 * | 6/2008 | Kim | 405/107 | |
| 2011/0011037 | A1 * | 1/2011 | Kean | 53/450 | |

FOREIGN PATENT DOCUMENTS

| | | | | |
|---|---|---|---|---|
| EP | 0 491 453 | A1 | 6/1992 | |
| EP | 0491453 | A1 | 6/1992 | |
| EP | 04910453 | A1 * | 6/1992 | E02D 31/00 |
| WO | WO 2008/087439 | A2 | 7/2008 | |

OTHER PUBLICATIONS

Reply and Defence to Counterclaim (First and Second Defendants), Environmental Defence Systems Limited (Claimant) and Synergy Health PLC et al. (Defendants), Claim No. CC13P03329.

Reply and Defence to Counterclaim (Third, Fourth and Fifth Defendants), Environmental Defence Systems Limited (Claimant) and Synergy Health PLC et al. (Defendants), Claim No. CC13P03329.

Expert Report of Professor Edmund Penning-Rowsell OBE—Filed on Behalf of the Defendants, Environmental Defence Systems Limited (Claimant) and Synergy Health PLC et al. (Defendants), Claim No. CC13P03329.

Expert Report of Gerry Hay, Environmental Defence Systems Limited (Claimant) and Synergy Health PLC et al. (Defendants), Claim No. CC13P03329.

Decision of IPEC, Environmental Defence Systems Limited (Claimant) and Synergy Health PLC et al. (Defendants), Claim No. CC13P03329.

English language abstract and machine-assisted translation for DE 19910366 extracted from the espacenet.com database on Jun. 26, 2012, 46 pages.

International Search Report for Application No. PCT/GB2010/051923 dated May 4, 2011, 6 pages.

* cited by examiner

METHOD OF MANUFACTURE OF A BARRAGE UNIT

RELATED APPLICATIONS

This application claims priority to and all the advantages of International Patent Application No. PCT/GB2010/051923, filed on Nov. 19, 2010, which claims priority to Great Britain Patent Application No. GB0920284.7, filed on Nov. 19, 2009.

BACKGROUND OF THE INVENTION

The present invention relates to a method of manufacture of a barrage unit. More particularly, but not exclusively, the present invention relates to a method of manufacture of a barrage unit including the steps of blowing fibres of a fibrous material into a chamber where they are mixed with an absorbent crystalline material before being deposited on a liner. In a further aspect the present invention relates to a barrage unit manufactured by the method according to the invention.

Barrage units which absorb water are known. PCT/GB2008/000185 discloses a barrage unit having a core comprising a mixture of an absorbent fibrous material and an absorbent crystalline material. Such barrage units are typically used as a defense against flooding or as a blast defense system.

Such known barrage units are typically manufactured by mixing together the absorbent fibrous material and absorbent crystalline material by hand. Alternatively, the two are laid down in layers. This approach has a number of drawbacks however. Firstly the barrage units tend to shed the absorbent crystalline material. When this gets wet it can form a low friction layer on the ground which can be dangerous. More significantly, this method of manufacture can result in an uneven distribution of the absorbent crystalline material, either at the time of manufacture or due to movement of the barrage unit thereafter. The uneven distribution can cause the crystals of the absorbent crystalline material to clump together when absorbing water. This reduces the rate of water uptake of the barrage unit and possibly also the total amount of water the barrage unit will absorb. It can also cause the barrage unit to expand in an unpredictable manner and form an undesirable final shape.

The method of manufacture of a barrage unit according to the invention seeks to overcome the problems of the prior art.

BRIEF SUMMARY OF THE INVENTION

Accordingly, in a first aspect, the present invention provides a method of manufacture of a barrage unit comprising providing a chamber having an outer wall having at least one aperture therein; providing a liner layer proximate to the aperture; blowing the fibres of a fibrous material into the chamber whilst providing an absorbent crystalline material to said chamber such that the two mix and exit the aperture onto the liner forming a pad; and, providing a further liner layer on the pad.

The resulting barrage unit absorbs water more rapidly than known barrage units, and also expands in a more predictable fashion. It does not shed absorbent crystalline material.

The absorbent crystalline material can be blown into the chamber.

Alternatively, the absorbent crystalline material can be dropped into the chamber under gravity.

The fibrous material can be provided as a fibrous web, the web being shredded before being blown into the chamber.

Preferably, the web is shredded by a hammer mill.

Preferably, the chamber is rotated about an axis during mixing and the mixture is deposited on the liner layer when the aperture in the outer wall of the chamber is proximate to the liner layer.

The liner layer can be provided as a strip which is displaced along its length adjacent to the outer wall of the chamber.

Preferably, the liner and further liner are sealed together, preferably adhered together.

The pad and liner layers can be arranged within a porous bag or sack.

Preferably, the method further comprises the step of vacuum packing the barrage unit.

The absorbent crystalline material can be a polymeric material. The polymeric material can be a super absorbent polymer. The super absorbent polymer can be one or more polyacrylate or polyacrylamide. The one or more polyacrylate or polyacrylamide can be a polyacrylate and/or polyacrylamide salt. The salt can be one or more alkali metal salt, preferably a sodium or potassium salt.

The fibrous material can be a cellulosic material. The cellulosic material can be a pulp fibre. The pulp fibre can be a wood pulp or a fibre crop material. The fibre crop material can be cotton pulp. Preferably, the fibrous material is biodegradable.

Preferably, the absorbent fibrous material comprises from 40% to 80% by weight of the pad.

The bag or sack can comprise a natural material, preferably a jute fabric. Preferably, the bag or sack is biodegradable.

The liner can comprise a hydrophilic material, preferably cotton. Preferably, the liner is biodegradable.

BRIEF DESCRIPTION OF THE DRAWINGS

The present invention will now be described by way of example only and not in any limitative sense with reference to the accompanying drawings in which.

DETAILED DESCRIPTION OF THE INVENTION

Figure 1A:
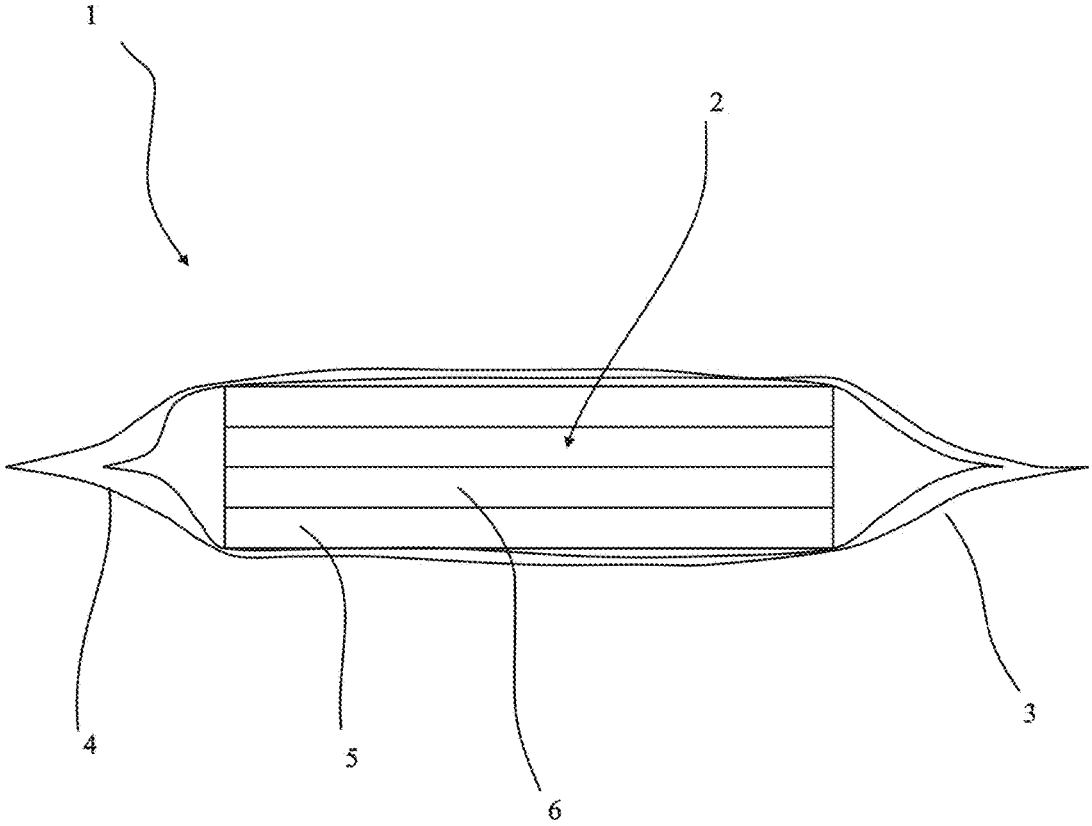
Figure 1(a) Prior Art
FIGS. 1(*a*) and 1(*b*) show, in cross section, a known barrage unit in dry and wet states.
Figure 1B:
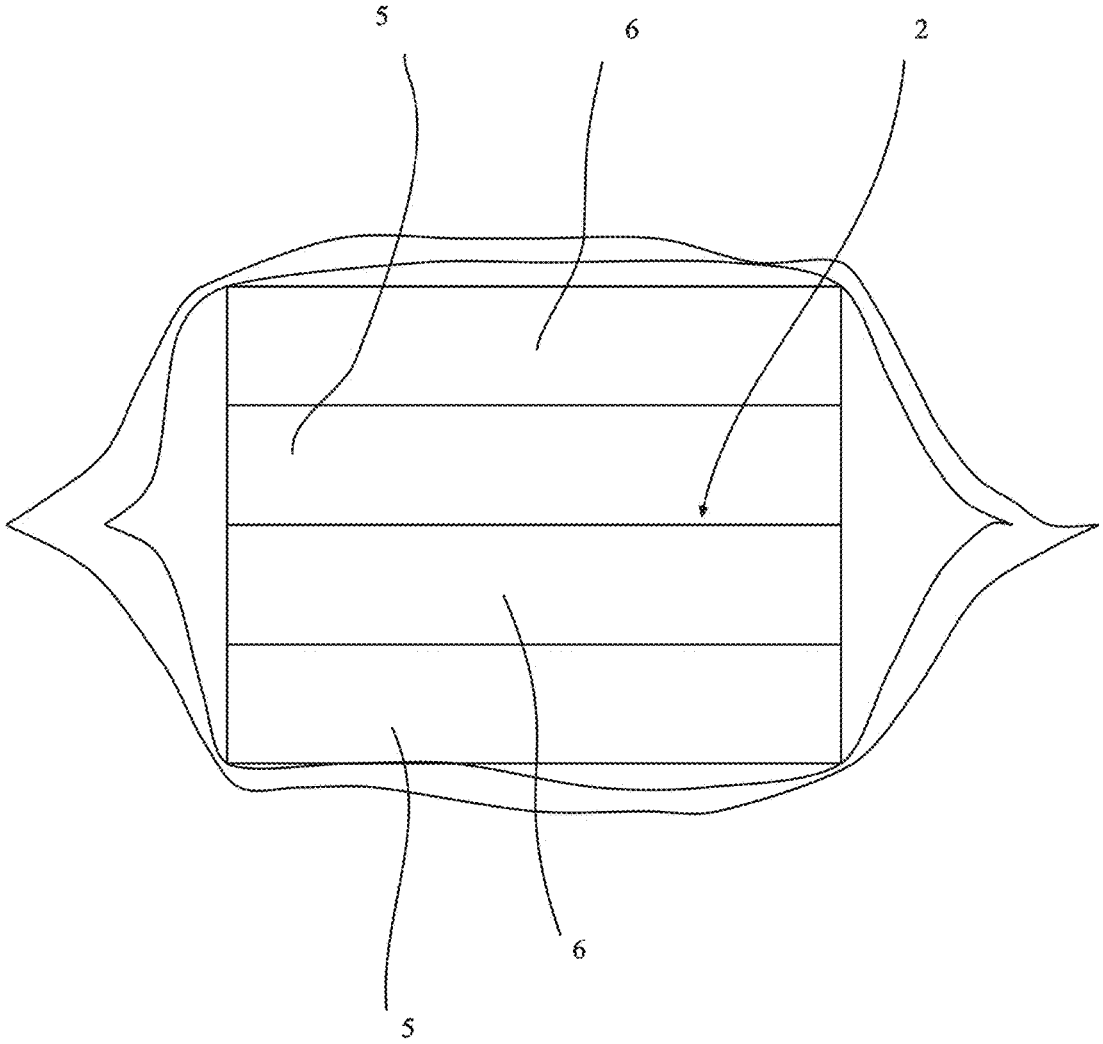
Figure 1(b) Prior Art

Shown in FIG. 1(*a*) is a known barrage unit 1 in a dry state. The barrage unit 1 comprises a pad 2 sandwiched between hydrophilic liner layers 3. The liner layers 3 are typically cotton adhered together around the edge of the pad 2. The liner layers 3 are arranged within a bag 4. The bag 4 is typically a jute bag.

The pad 2 comprises alternating layers of fibrous material 5 and absorbent crystalline material 6 as shown. The pad 2 is typically manufactured by laying these layers 5, 6 down one at a time on a lining layer 3, either by machine or by hand.

When the barrage unit is wetted the layers 5, 6 expand as shown in FIG. 1(*b*). In this example the pad 2 is substantially rectangular so that when expanded the barrage unit 1 is the brick like shape of a typical sandbag. When expanded the barrage unit 1 is often used as a flood or blast protection device.

In an alternative embodiment of a known barrage unit (not shown), the fibrous material and absorbent crystalline material are mixed together to give an approximately uniform distribution throughout the pad.

As discussed above however, such known barrage units 1 have a number of drawbacks. Firstly, because the fibrous material and absorbent crystalline material are not tightly bound together the barrage unit 1 tends to shed the absorbent crystalline material. When wet this can form a dangerous low friction layer on the ground.

The absorbent crystalline material also tends to move within then barrage unit 1 when the barrage unit is moved or stored. This can lead to an undesirable distribution of the absorbent crystalline material. When the barrage unit 1 absorbs water the crystalline material can for example clump together reducing the rate of water uptake. This could be important, for example, when the barrage unit 1 is being used as a flood defense unit with the barrage unit 1 swelling in the water to block an aperture or form a defense wall. Any delay in the barrage unit 1 absorbing the water may increase the amount of flood damage.

Incorrect distribution of the crystalline material can also result in the barrage unit 1 swelling to the incorrect shape. For example in this embodiment if all the absorbent crystalline material is at one end of the barrage unit 1 as a result of the way the barrage unit 1 has been stored, then the barrage unit 1 may not expand to the desired rectangular shape. This can make it difficult the stack the barrage units 1 as a wall.

Figure 2:
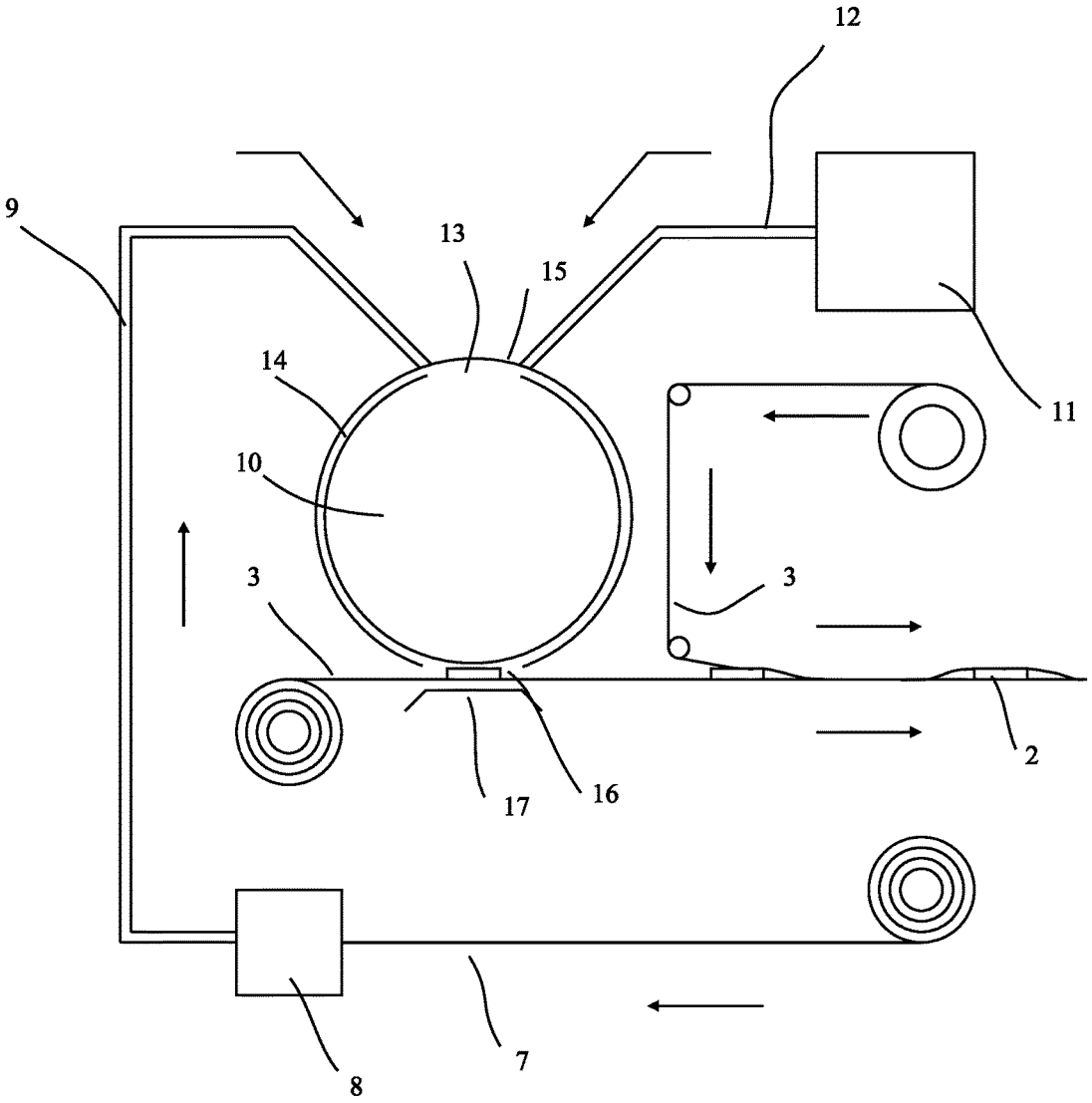
FIG. 2 shows, in schematic form, a method of manufacture of a barrage unit according to the invention; and, FIGS. 3(*a*) to 3(*c*) show, in schematic form, the deposition of the pad on a liner layer.

FIG. 2 shows a method of manufacture of a barrage unit 1 according to the invention.

A fibrous material is provided as a fibrous web 7. The web 7 is drawn through a hammer mill 8 where it is shredded into small pieces. The pieces, preferably individual fibres, are then blown along a conduit 9 into a chamber 10.

At the same time as the above an absorbent crystalline material is drawn from a material store 11 into the chamber 10. Again, this is typically done by blowing the crystalline material along a conduit 12. In an alternative embodiment of the invention the crystalline material is slowly deposited in the chamber 10 from a store under the action of gravity.

Within the chamber 10, the action of the fibrous material being blown into the chamber 10 thoroughly mixes it with the crystalline material. Once mixed together the mixture exits the chamber 10 through apertures 13 in the chamber outer wall 14 onto a lining 3. In this embodiment the chamber 10 slowly rotates about an axis as shown. The chamber 10 rotates within a fixed housing 15 which also has an aperture 16. It is only when the aperture 16 of the housing 15 and the aperture 13 of the chamber 10 are lined up that the mixture exits the chamber 10 onto the lining 3 to form a pad 2 on the lining 3.

The lining 3 is provided as a long sheet. The lining 3 is drawn past the outer wall 14 of the chamber 10 as shown. The lining 3 is drawn past the chamber 10 at substantially the same linear velocity as the outer wall 14 of the chamber 10 such that the outer wall 14 of the chamber 10 is stationary when in contact with the lining 3. The lining 3 is supported by a support plate 17 when in contact with the outer wall 14 of the chamber 10 so that the chamber wall 14 can be firmly pressed into contact with the lining 3.

Figure 3:
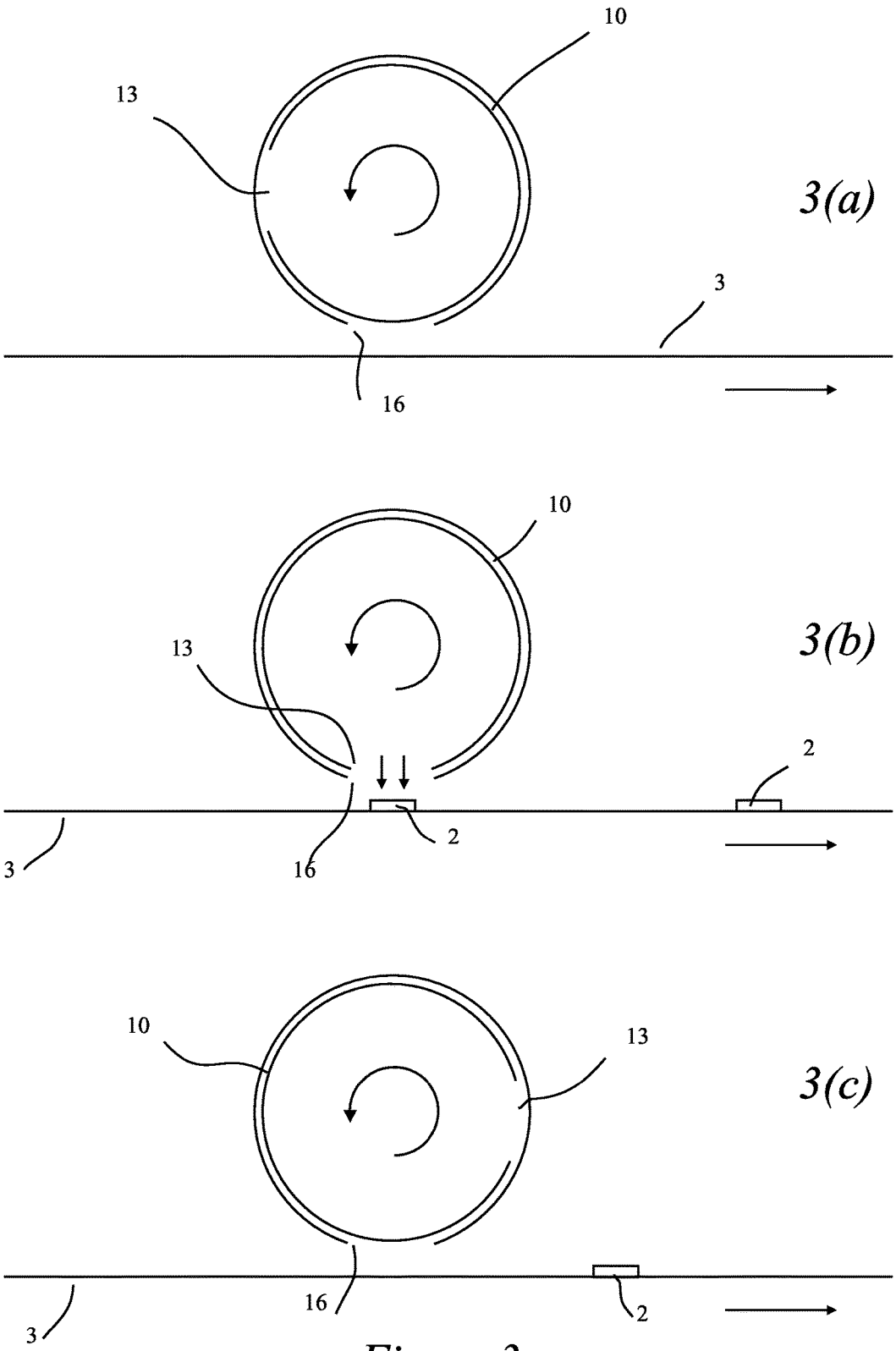

Deposition of the pad 2 onto the lining 3 is shown in greater detail in FIGS. 3(*a*) to 3(*c*). In FIG. 3(*a*) the housing aperture 16 and chamber aperture 13 are not aligned. In FIG. 3(*b*) the chamber 10 has rotated slightly such that the apertures 13, 16 align, depositing the pad 2 onto the lining 3. In FIG. 3(*c*) the chamber 10 has rotated further so that the apertures 13, 16 are no longer aligned.

Figure 4:
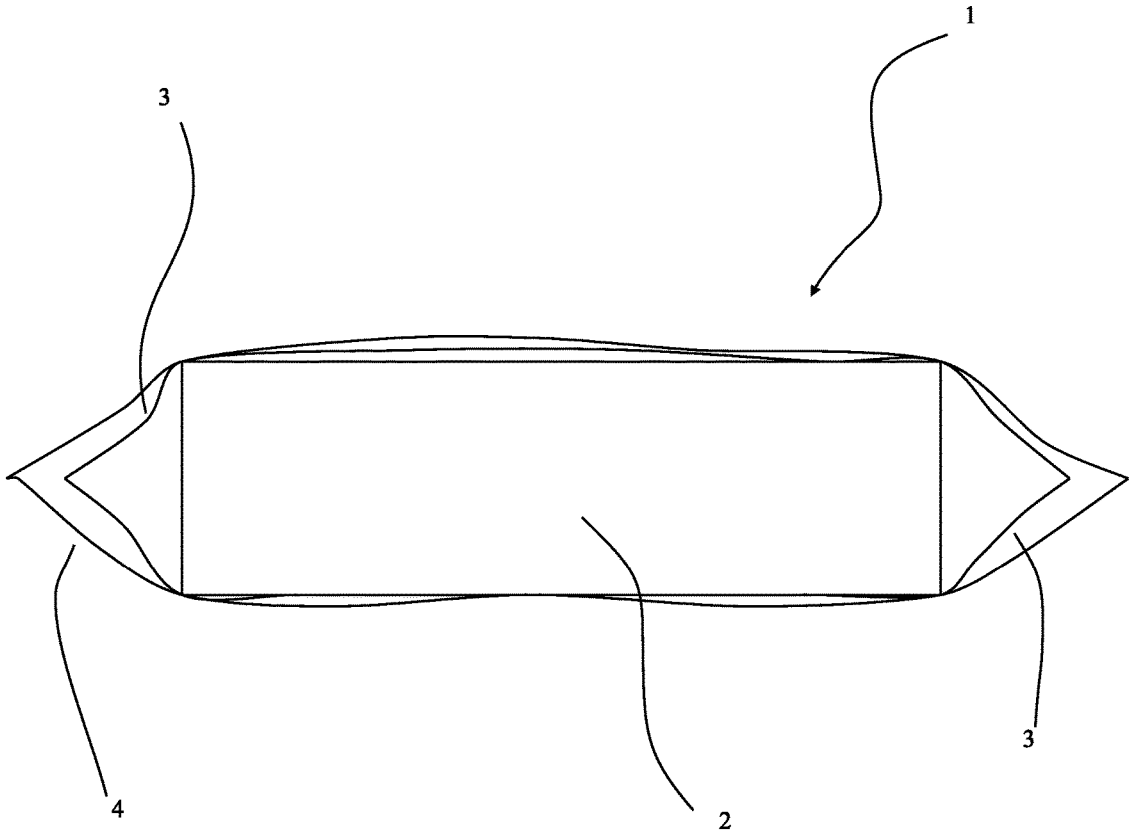
FIG. 4 shows, in cross section, a barrage unit according to the invention in cross section.

Returning to FIG. 2, a further lining 3 is laid down on the pad 2 sandwiching the pad 2 therebetween. The two lining layers 3 are then cut around the pad 2 and the edges adhered together before being inserted into a bag 4. The open mouth of the bag is typically stitched closed to produce the barrage unit 1 as shown in FIG. 4.

The barrage unit 1 according to the invention has a number of advantages over known barrage units 1. The barrage unit 1 tends not to shed the crystalline material making them safer to use. They absorb water more quickly than known barrage units 1 and also tend to expand in a known and predictable manner.

As a further optional step the barrage unit 1 is vacuum packed before distribution to users. It has been found that the step of vacuum packing improves the performance of the barrage unit 1 after unpacking, in particular increasing its rate of water uptake.

Figure 5:
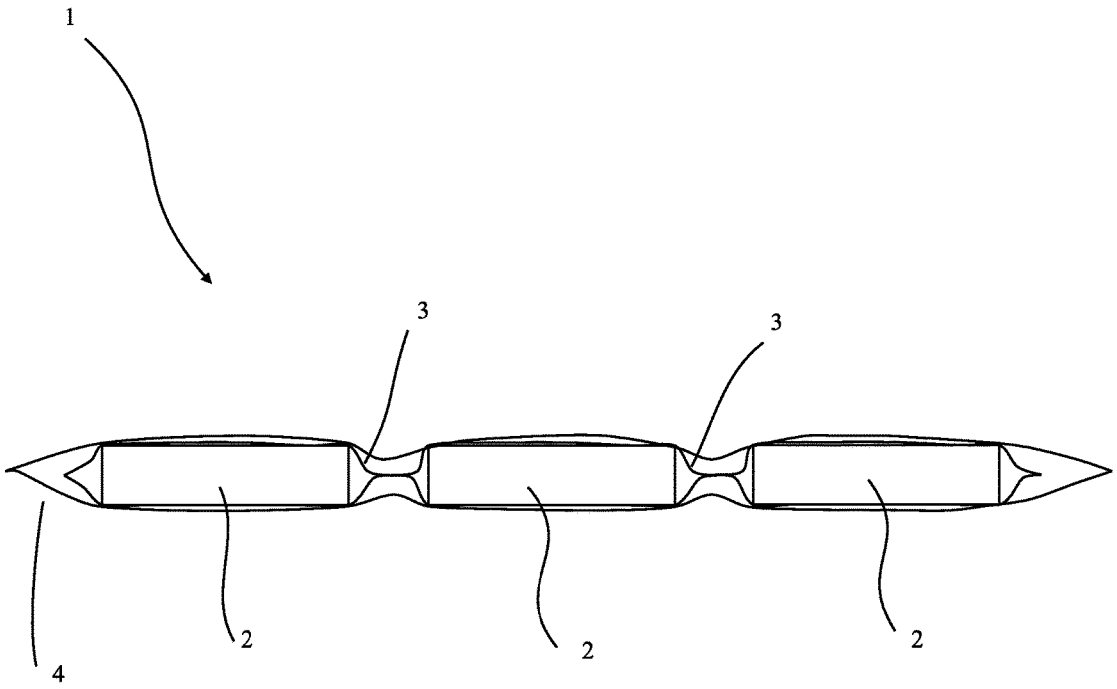
FIG. 5 shows in cross section a further embodiment of a barrage unit according to the invention; and, FIG. 6 shows a further embodiment of a barrage unit according to the invention.

FIG. 5 shows a further embodiment of a barrage unit 1 according to the invention. This barrage unit 1 comprises a plurality of pads 2 within the bag. Such elongate barrage units 1 can be used for example in doorways to prevent flood damage.

Figure 6:
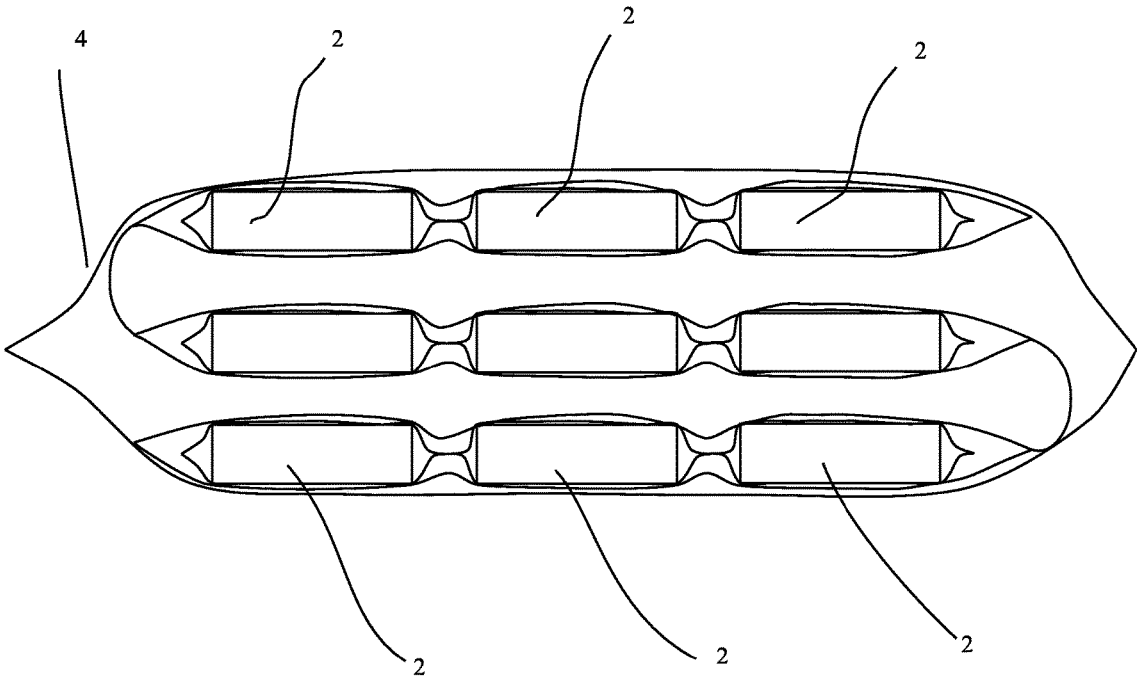

FIG. 6 shows a larger barrage unit 1 manufactured by the method according to the invention. This embodiment of the barrage unit 1 comprises several layers of pads 2 within the bag 4.

The pads can be shapes other than rectangular—one simply changes the shape of the aperture(s) in the outer wall of the chamber or the housing.

The absorbent crystalline material is preferably a polymeric material such a superabsorbent polymer. A number of different superabsorbent polymers are available for example polyacrylates and or polyacrylamides, especially polyacrylate and/or polyacrylamide salts, such as the alkali metal salts eg sodium or potassium salts. These types of substance can hold up to 200 times their own weight of water as the crystals can form an absorbent gelling polymer when saturated with fluid. It is well understood by one skilled in the art that mixtures of superabsorbent polymers may be used.

Other materials are also used to make a superabsorbent polymer, such as polyacrylamide copolymer, ethelene maleic anhydride copolymer, cross linked carboxy-methylcellulose, polyvinyl alcohol copolymers, cross linked polyethylene oxide, and starch grafted copolymer of polyacrylonitrile.

The fibrous material preferably comprises a cellulosic material, for example a pulp fibre, such as a wood pulp of fibre crop material, such a as a cotton pulp and the like. There are numerous other fibre crop materials available and it will be appreciated by the person skilled in the art that a number of such materials and/or mixtures of such materials may be used. Preferably, the fibrous material is biodegradable.

The ratio of absorbent crystalline material to absorbent fibrous material may vary and may depend on a number of factors such as the nature of the crystalline material eg the superabsorbent polymer, the nature of the fibrous material eg pulp material and the use to which the bag or sack will be put eg flood defense system or blast defense system. Thus, for example of the pad the fibrous material may comprise from 40% to 80% by weight, preferably from 50% to 70% by weight, more preferably 55% to 65% by weight, the crystalline material making all or a substantial portion of the remainder.

The bag or sack of the barrage unit may comprise any conventional material known as a sacking material, thus it may be a natural material or a synthetic material or a combination of such materials. Thus, an example of a natural material is a jute fabric and an example of a synthetic material is a loosely woven polypropylene. A jute fabric is preferred because of, inter alia, its hydrophilicity. Typically a non woven material is used for the bag or sack. The sack can be a nonwoven polypropylene. The bag or sack may be biodegradable.

The liner layers 3 typically comprise a hydrophilic material, such cotton or fibrework. The upper and lower liner layers 3 are cut during manufacture around one or more pads 2 and then the edges typically glued together to encapsulate the pads 2. The layers 3 may be sealed together in other ways, for example by sewing the layers together. Preferably, the liner layers 3 are biodegradable.

In the above method, the drum 10 rotates with respect to a fixed housing 15. In an alternative embodiment (not shown) the drum 10 is fixed and has a gate which opens and closes over the aperture. The gate is opened in order to deposit a pad 2 onto the lining 3.

What is claimed is:

1. A method of manufacture of a barrage unit for use as a flood defence unit comprising the steps of:

providing a fixed housing having an aperture in the housing wall;

providing a chamber within the fixed housing, the chamber having an outer wall having at least one aperture therein, the chamber being adapted to rotate about an axis with respect to the fixed housing such that the housing wall aperture and chamber aperture periodically align;

providing a liner layer proximate to the housing aperture;

blowing fibres of a fibrous material into the chamber whilst blowing a crystalline superabsorbent polymer into the chamber such that the two mix, the chamber rotating about the axis during mixing such that a substantially uniform mixture exits the chamber when the housing and chamber apertures align proximate to the liner layer and onto the liner layer forming a pad, the fibrous material comprising from 40% to 80% by weight of the pad and the crystalline material making all or a substantial portion of the remainder;

depositing a plurality of pads along the liner layer;

providing a further liner layer onto each of the plurality of pads;

adhering the liner layer and the further liner layer between each of the adjacent pads; and positioning the plurality of pads within a porous bag to form the barrage unit haying a plurality of layers of pads within the porous bag.

2. The method as claimed in claim 1, wherein the fibrous material is provided as a fibrous web, the web being shredded before being blown into the chamber.

3. The method as claimed in claim 2, wherein the web is shredded by a hammer mill.

4. The method as claimed in claim 1, wherein the liner layer is provided as a strip which is displaced along its length adjacent to the outer wall of the chamber.

5. The method as claimed in claim 1, wherein the liner and further liner are sealed together.

6. The method as claimed in claim 1, wherein the bag comprises a natural material.

7. The method as claimed in claim 6, wherein the bag is biodegradable.

8. The method as claimed in claim 6, wherein the liner is biodegradable.

9. The method as claimed in claim 1, further comprising vacuum packing the barrage unit.

10. The method as claimed in claim 1, wherein the super absorbent polymer is one or more polyacrylate or polyacrylamide.

11. The method as claimed in claim 10, wherein the one or more polyacrylate or polyacrylamide is a polyacrylate or polyacrylamide salt.

12. The method as claimed in claim 11, wherein the salt is one or more alkali metal salt.

13. The method as claimed in claim 1, wherein the fibrous material is a cellulosic material.

14. The method as claimed in claim 13, wherein the cellulosic material is a pulp fibre.

15. The method as claimed in claim 14, wherein the pulp fibre is a wood pulp or a fibre crop material.

16. The method as claimed in claim 15, wherein the fibre crop material is cotton pulp.

17. The method as claimed in claim 1, wherein the fibrous material is biodegradable.

18. The method as claimed in claim 1, wherein the liner layer is supported by a support plate and is drawn past the chamber at a substantially similar linear velocity.

19. The method as claimed in claim 1, wherein the liner comprises a hydrophilic material.

* * * * *